US005838275A

United States Patent [19]

Carmi

[11] Patent Number: 5,838,275

[45] Date of Patent: Nov. 17, 1998

[54] MARINE PERSONAL LOCATOR AND AUTOMATIC OPENING OMNIDIRECTIONAL RADAR RETROREFLECTOR INCORPORATED THEREIN

[76] Inventor: Ariel Carmi, Bnei-Efraim 211/3, Tel-Aviv, 69984, Israel

[21] Appl. No.: 725,619

[22] Filed: Oct. 3, 1996

[51] Int. Cl.[6] ..... H01Q 15/00

[52] U.S. Cl. ..... 342/8; 342/10

[58] Field of Search ..... 342/8, 9, 10

[56] References Cited

U.S. PATENT DOCUMENTS

| | | | |
|---|---|---|---|
| 1,320,142 | 10/1919 | Hanson | 318/16 |
| 2,151,336 | 3/1939 | Scharlau | 342/385 |
| 2,470,783 | 5/1949 | Mead | 441/8 |
| 2,629,115 | 2/1953 | Hansen | 441/36 |
| 2,646,019 | 7/1953 | Chetlan | 342/10 X |
| 2,756,948 | 7/1956 | Winzen et al. | 342/10 X |
| 2,888,675 | 5/1959 | Pratt et al. | 342/8 |
| 3,019,457 | 2/1962 | Lowery | 342/8 X |
| 3,115,631 | 12/1963 | Martin | 342/8 |
| 3,130,406 | 4/1964 | Jones-Hinton et al. | 342/8 |
| 3,142,063 | 7/1964 | Goetzmann, Jr. | 343/706 |
| 3,155,992 | 11/1964 | Shewmake et al. | 342/10 X |
| 3,181,158 | 4/1965 | Feldman | 342/10 |
| 3,283,328 | 11/1966 | Wood | 342/8 X |
| 3,449,747 | 6/1969 | Daughenbaugh et al. | 342/8 |
| 3,604,001 | 9/1971 | Deal | 342/7 X |
| 3,623,107 | 11/1971 | Holdren, III | 342/5 |
| 3,671,965 | 6/1972 | Rabenhorst et al. | 342/8 |
| 3,721,983 | 3/1973 | Sherer | 342/10 |
| 3,727,229 | 4/1973 | Clinger et al. | 342/10 X |
| 3,902,176 | 8/1975 | Lewis et al. | 342/6 |
| 4,044,711 | 8/1977 | Jamison | 342/10 X |
| 4,051,479 | 9/1977 | Altshuler | 343/703 |
| 4,072,948 | 2/1978 | Drews et al. | 342/7 |
| 4,120,259 | 10/1978 | Wilson | 342/8 X |
| 4,123,987 | 11/1978 | Singerle et al. | 342/10 X |
| 4,185,582 | 1/1980 | Bryant | 116/210 |
| 4,633,263 | 12/1986 | Altshuler | 343/706 |
| 4,673,934 | 6/1987 | Gentry et al. | 342/8 |
| 4,885,591 | 12/1989 | Page | 342/450 |
| 4,980,688 | 12/1990 | Dozier, Jr. | 342/9 |
| 5,065,163 | 11/1991 | Mears | 343/706 |
| 5,457,472 | 10/1995 | Bjordal et al. | 343/912 |
| 5,530,445 | 6/1996 | Veazy | 342/8 |
| 5,736,954 | 4/1998 | Veazy | 342/8 |

*Primary Examiner*—John B. Sotomayor

*Attorney, Agent, or Firm*—Schweitzer Cornman Gross & Bondell LLP

[57] ABSTRACT

An improved omnidirectional radar retroreflector and marine personal locator incorporating same. One embodiment of the radar retroreflector includes first and second collapsible radar reflective disc portions biased in a substantially perpendicular open position with a plurality of radar reflecting web sections extending substantially perpendicularly therebetween creating eight sets of three mutually-perpendicular radar reflective surfaces forming an omnidirectional radar retroreflector. In a collapsed position, the first and second disc portions bend around a common axis of intersection in a non-destructive manner folding the web sections. A second embodiment of the radar retroreflector consists of a balloon having, when inflated, two intersecting disc-shaped portions oriented substantially perpendicularly and a plurality of radar reflecting web sections extending substantially perpendicularly therebetween creating eight sets of three mutually-perpendicular radar reflective surfaces and forming an omnidirectional radar retroreflector. A marine personal locator, prior to activation, restrains the radar retroreflector in a collapsed position. The radar retroreflector opens upon activation and is suspended on a tether by a balloon. The marine personal locator can also include a light source and a radio transmitter. Prior to activation of the marine personal locator, all components can be contained within a housing.

4 Claims, 4 Drawing Sheets

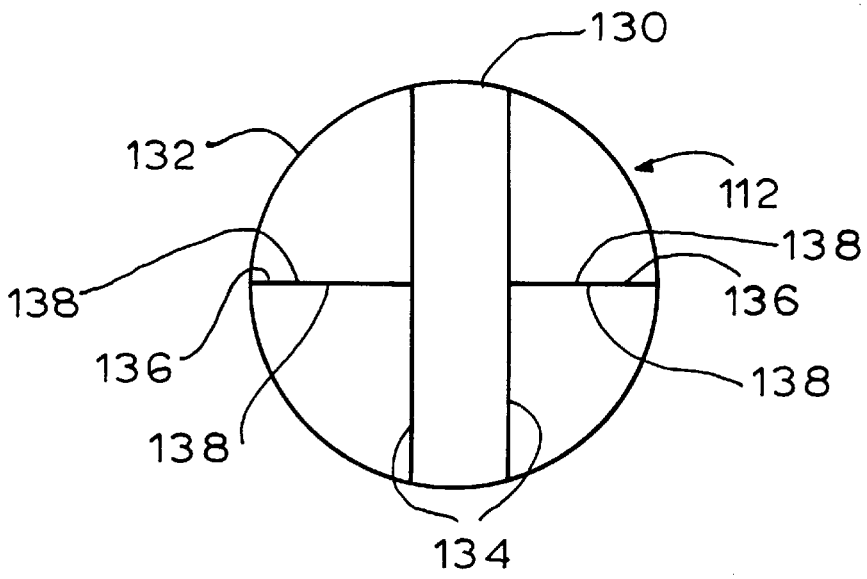
FIG. 6
FIG. 7
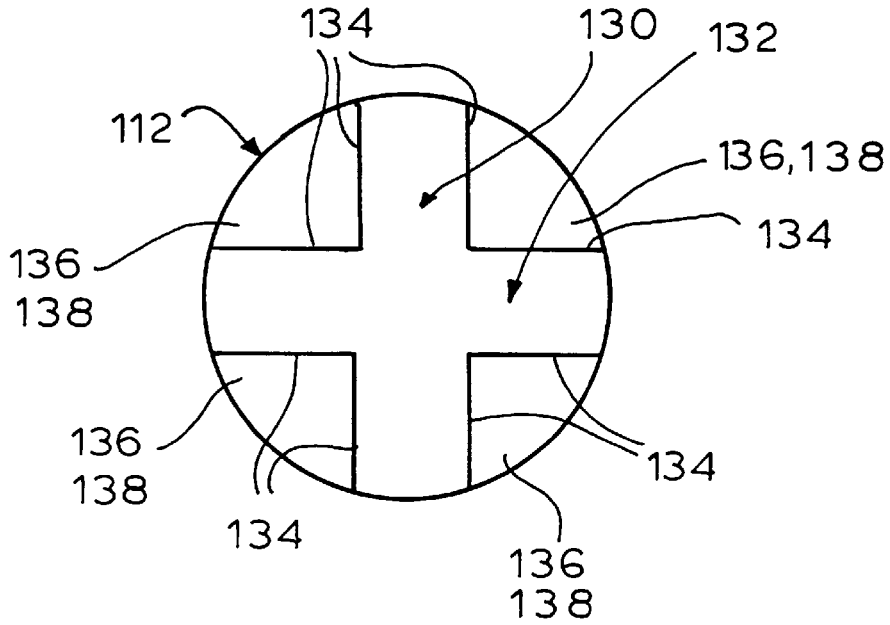

MARINE PERSONAL LOCATOR AND AUTOMATIC OPENING OMNIDIRECTIONAL RADAR RETROREFLECTOR INCORPORATED THEREIN

FIELD OF THE INVENTION

This invention relates to the field of marine rescue devices and, in particular, to marine radar retroreflectors and personal safety devices for locating persons and objects in marine environments.

BACKGROUND OF THE INVENTION

Most marine safety devices employ one of three basic methods to increase the likelihood of the location and rescue of persons and objects at sea. These are: visual contact, radio location and radar detection. Visual contact can be a fast and accurate method to locate a person or object (such as a stranded or distressed vessel) on the surface of a body of water. However, many times visual contact can be extremely difficult, if not impossible, even if the target is known to be within a certain area. This is especially true if there is little or no daylight, high wave height and/or low visibility. In any case, visual contact of small objects at the water's surface is usually limited at best to a few hundred yards. While visual detection can be enhanced with the use of known safety devices such as lights or flares, these aids are of limited use. Flares are only active for a short period of time and lights at the surface of the water may be obscured by waves and other adverse conditions.

Historically, radio location has been a very effective way to find persons and vessels floating at the surface of a body of water. In fact, this is a method employed by the U.S. military to locate downed pilots. Also, by regulation, most ships are required to monitor naval emergency channels, so the chances of detecting an emergency signal are high. Radio location is effective because radio waves are able to penetrate almost all weather conditions. However, while radio location is a robust method to find a person at sea, the location of the signal cannot be determined immediately but must be calculated or plotted using triangulation, which requires time, equipment and skills which may not be available in all situations. Therefore, radio location may not always be the most desirable method to find objects at sea.

The other method to locate objects at sea is radar detection. This method is extremely effective for locating objects which project upwards from the surface of the water, such as ships, land masses, navigational aids, etc., because the precise distance and bearing to the object is instantly available. Radar, however, is not an effective method to locate a person floating at the surface of the water. This is because the human body does not reflect radar waves well and, with the present state of technology, radar systems cannot distinguish between radar "noise" created by waves (and other objects at the water surface) and a reflection created by the body of a person floating at the surface of the water.

It is known that the radar reflectivity of those objects normally detectible by radar can be increased with the use of omnidirectional radar retroreflectors. These reflectors typically have surfaces which are highly reflective of radar signals, and are thus highly "visible" to radar. Also, the surfaces are aligned so that they are retroreflective, that is they reflect some of the radar signal incident thereon back to the radar unit. And, the retroreflective surfaces are arranged such that the reflector is omnidirectional so that, regardless of the direction of the incoming signal, a portion is always reflected back in a parallel path. To increase the distance from which they may be detected, radar retroreflectors are typically placed or hoisted in an elevated position on the object. Known radar reflectors typically consist of rigid radar reflective panels or discs which may be folded for storage and which are assembled manually.

These types of radar reflectors are not suitable to locate a person floating at the surface of the water, however, because, they cannot be carried conveniently on the body of a person. Therefore, it is unlikely that the person who has fallen overboard will have one available when required. Also, although known radar retroreflectors could potentially increase the radar image of a person floating at the surface of a body of water, current radar systems cannot distinguish that true image from "noise" generated by other radar reflective objects at the water surface, such as waves. Moreover, known radar retroreflectors require manual assembly which may be difficult, if not impossible to accomplish for a person who is attempting to stay afloat.

Therefore, what is desired is an improved radar retroreflector and a marine personal safety device which incorporates such a retroreflector, which are compatible with existing sensing technology and which provide for enhanced visual contact, radio location and radar detection of objects floating on the surface of a body of water.

SUMMARY OF THE INVENTION

Accordingly, it is an object of the invention to provide an automatic opening, omnidirectional radar retroreflector and a marine personal locator incorporating such a retroreflector which provide for enhanced visual contact, radio location and radar detection of objects floating on the surface of a body of water.

It is another object of the invention to provide a radar retroreflector of the above character which is collapsible in a non-destructive manner and which can open automatically.

It is yet another object of the invention to provide a radar retroreflector of the above character in the form of a balloon.

It is still another object of the invention to provide a radar retroreflective balloon of the above character with a protective cover which is transparent to radar waves.

It is yet still another object of the invention to provide a radar retroreflector of the above character in a marine safety locator wherein the retroreflector may be suspended above an object floating at the surface of a body of water.

It is another object of the invention to provide a marine personal locator of the above character with a light source and a radio transmitter.

These and other objects of the invention are realized by an omnidirectional automatic opening radar retroreflector having first and second resiliently deformable disc portions with radar reflective surfaces on opposite sides thereof. The first and second disc portions are biased in an open position in which each disc portion is oriented substantially perpendicular to the other. The first and second disc portions, when open, form four sets of two perpendicular radar reflective surfaces. A third disc portion is comprised of a plurality of web sections. Each web section, when open, extends substantially perpendicularly between and substantially bisects facing surfaces of one of the four sets of two radar reflecting surfaces. The web sections and the first and second resiliently deformable discs form eight sets of three mutually-perpendicular radar reflective surfaces which are arranged such that said retroreflector is omnidirectional. The first and second disc portions can bend around a common axis of intersection such that they are collapsible in a non-destructive manner. The first and second discs can be comprised of sheet metal and the web sections can be comprised of metal foil.

The objects of the invention are also realized by an omnidirectional radar retroreflector balloon having, when inflated, two intersecting disc-shaped portions oriented substantially perpendicularly to one another, where the disc-shaped portions form four sets of two substantially perpendicular radar reflective surfaces. The balloon also has a plurality of web sections with radar reflecting surfaces on opposite sides thereof, where each web section extends substantially perpendicularly between and substantially bisects facing surfaces of one of the four sets of radar reflecting surfaces so that the web sections and said disc-shaped portions form eight sets of three mutually-perpendicular radar reflective surfaces and so that the radar retroreflector balloon is omnidirectional.

These and other objects of the invention are also realized by a marine personal locator incorporating one of the above embodiments of the radar retroreflector wherein the retroreflector, prior to activation of the marine personal locator is restrained in a housing adapted to be carried or worn on the body of a person, and after activation, is suspended above the person on a tether. The marine personal locator can also include a light source and a radio transmitter.

BRIEF DESCRIPTION OF THE DRAWING

For a complete understanding of the above and other features and advantages of the invention, reference should be made to the following detailed description of the preferred embodiments of the invention and to the accompanying drawings wherein:

FIG. 6 is a side elevation view of the balloon of FIG. 5; and

FIG. 7 is a top plan view of the balloon of FIG. 5.

DETAILED DESCRIPTION OF THE INVENTION

Figure 1:
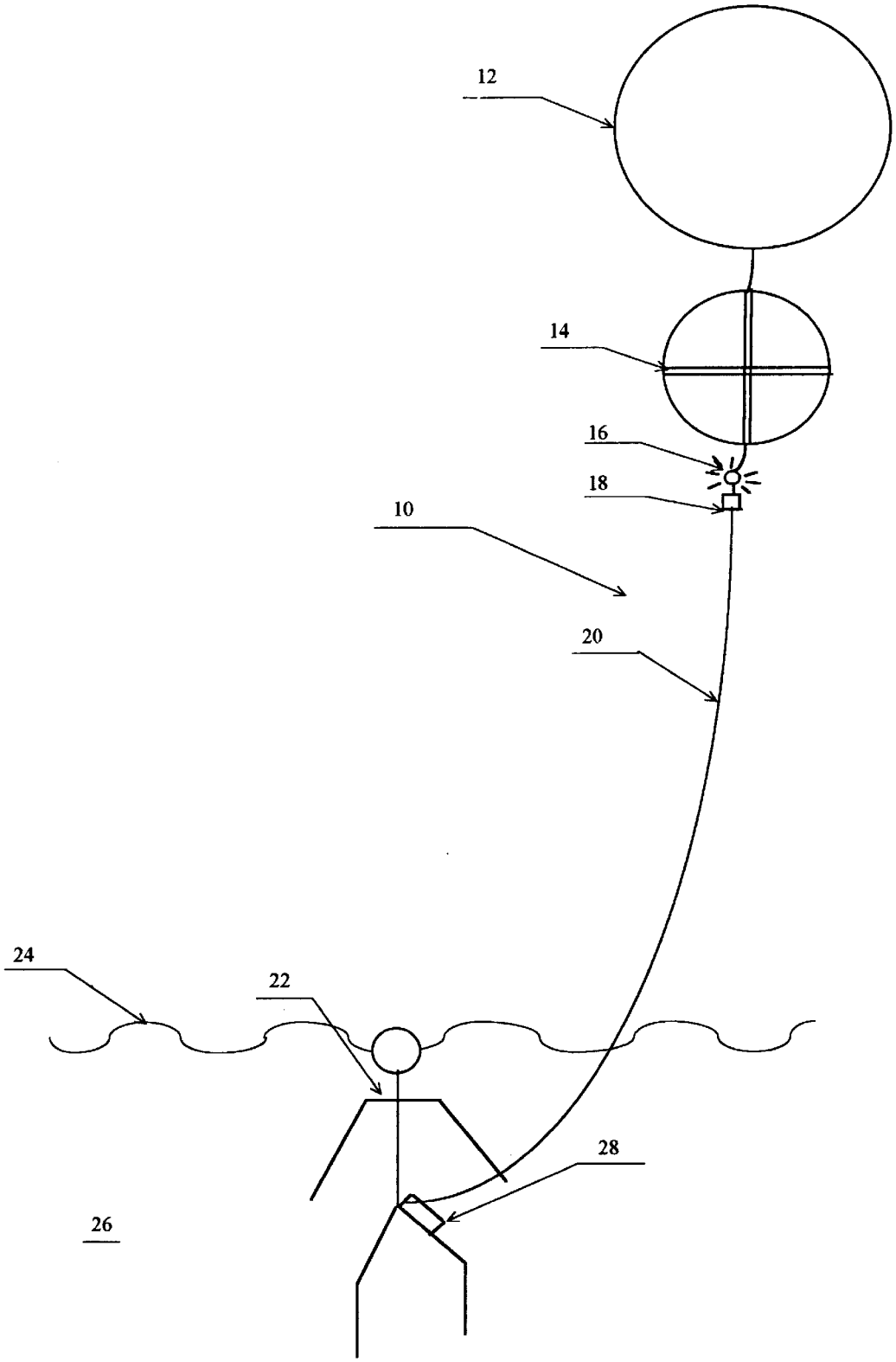
FIG. 1 is a schematic drawing of one embodiment of the marine personal locator device after activation.

Referring to FIG. 1, the marine personal locator 10 of the present invention includes a balloon 12, a radar retroreflector 14, a light source 16, a transmitter 18 and a tether 20. The balloon 12 suspends the retroreflector 14, the light source 16 and the transmitter 18 on the tether 20 above a person 22 floating at the surface 24 of a body of water 26 so that the emissions of radar, radio and light waves can be detected by search aircraft and watercraft more easily and at greater distances. The power to operate the light source 16 and the transmitter 18 is preferably generated by batteries (not shown) contained in the transmitter and/or light source. Prior to activation of the marine personal locator 10, preferably the contents are contained with a housing 28 which is preferably cylindrical and which can be attached to, carried by or worn on the body of a person 22 so that the marine personal locator 10 will be available when required.

Figure 2:
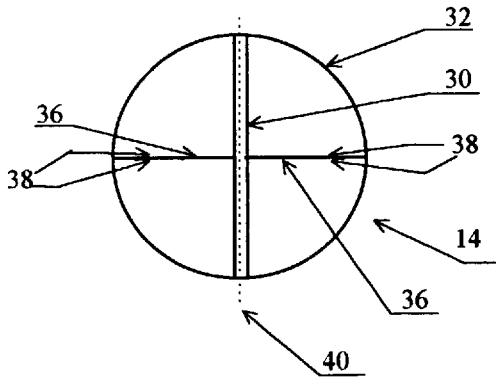
FIG. 2 is a side elevation view of the omnidirectional radar retroreflector of FIG. 1.
Figure 3:
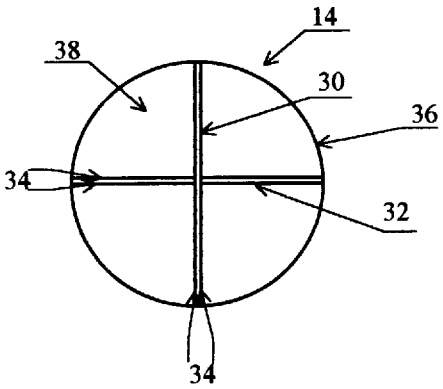
FIG. 3 is a top plan view of the omnidirectional radar reflector of FIG. 1.

Referring to FIGS. 2 and 3 preferably the radar retroreflector is comprised of two resiliently deformable discs 30, 32 which have radar reflective surfaces 34 and which are secured to one another substantially perpendicularly. Connected between adjacent surfaces of the discs 30, 32 are web sections 36, such as sections of foil, which also have radar reflective surfaces 38. In an open position, the discs 30, 32 and the webs 36 form eight sets of three mutually-perpendicular radar reflective surfaces so that the radar reflector is retroreflective as well as omnidirectional. Omnidirectional radar reflection is a preferable feature of the present invention for two reasons. First, by definition, an omnidirectional radar retroreflector can be "seen" by a radar unit from any direction. Second, even if the omnidirectional radar reflector is rotating or moving slightly, it will always produce a constant, non-blinking image on a radar receiving unit. This is significant because, as compared to a blinking image, a constant image is easier to notice and locate in a marine environment.

Figure 4:
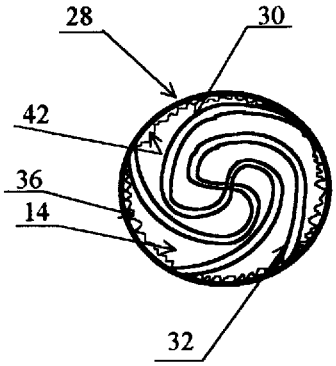
FIG. 4 is a top cross-sectional view of the omnidirectional radar reflector of FIG. 1 shown collapsed in the housing of the marine personal locator device prior to activation.

Referring to FIG. 4, the retroreflector 14 can be resiliently deformed in a non-destructive manner so that it can fit into the relatively small housing 28. Preferably, the discs 30, 32 can be bent around a common axis of intersection 40 (see FIG. 2) into a substantially spiral configuration while the web sections 36 fold between adjacent surfaces of the discs 30, 32. The retroreflector 14 can be restrained by the walls 42 of the housing 28 or by another device such as a restraining band (not shown). The retroreflector 14 is biased in an open position (as shown in FIGS. 2 and 3) preferably by the resiliency of the discs 30, 32 so that, when unrestrained, the discs 30, 32 will open automatically, forming the omnidirectional radar retroreflector.

Referring again to FIG. 1, the marine personal locator 10 also includes a source of pressurized gas (not shown) which is lighter than air to inflate and give buoyancy to the balloon 12 when the marine personal locator 10 is activated. Preferably, this source of pressurized gas is also contained within the housing 28. Upon activation of the marine personal locator 10, the balloon 12 fills with gas and expands out of the housing 28. As the balloon 12 exits the housing 28, it pulls out the tether 20 with the light source 16, radio transmitter 18 and radar retroreflector 14 attached. After the retroreflector 14 exits the housing 28, it is no longer restrained and, therefore, opens automatically. The balloon 12, hoists the light source 16, radio transmitter 18 and radar retroreflector 14 into the air above the person 22 in the water for easier and more remote detection by search craft.

Figure 5:
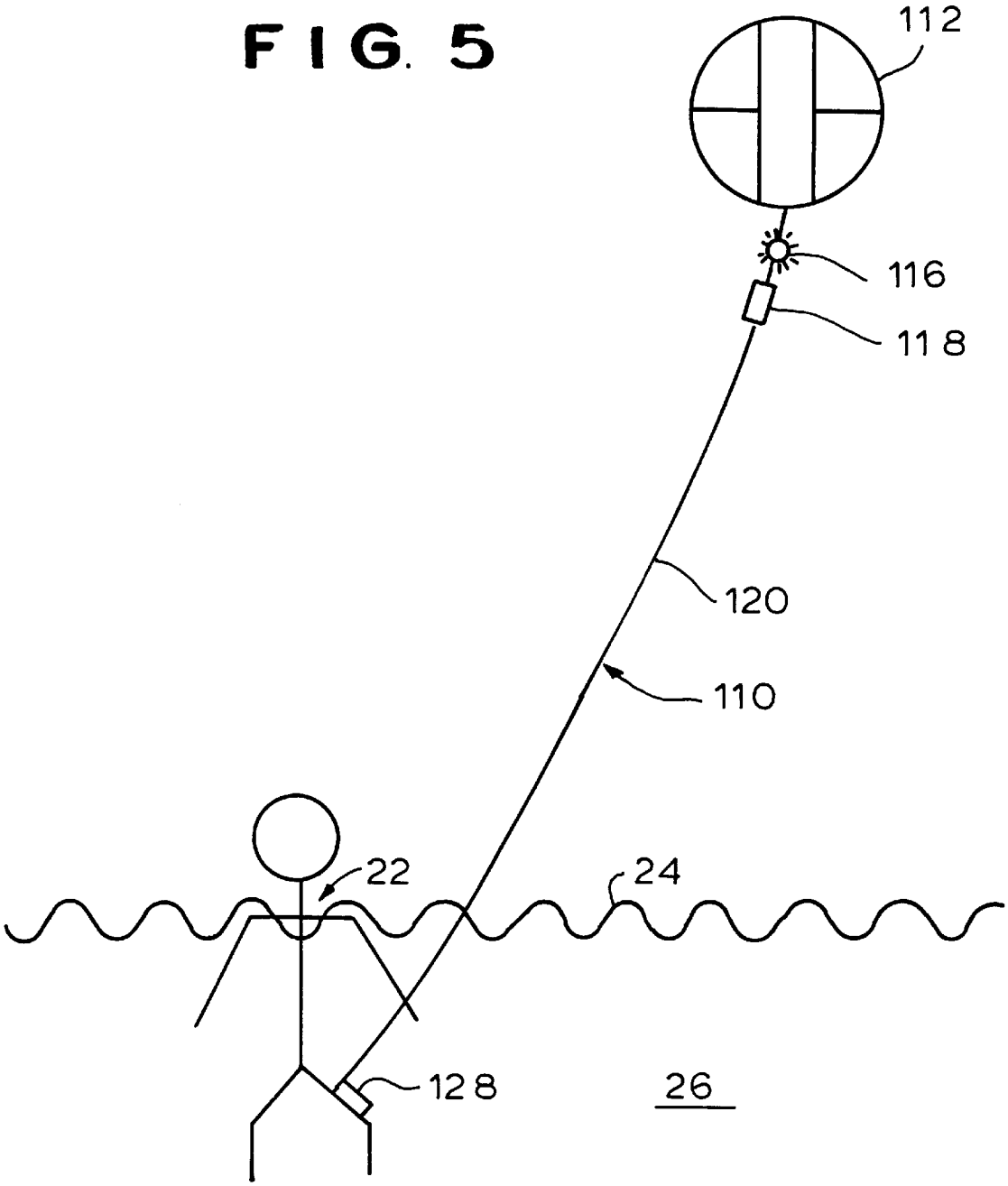
FIG. 5 is a schematic drawing of a second embodiment of the marine personal locator device after activation, showing a balloon also performing as an omnidirectional radar retroreflector.

Referring to FIG. 5, the balloon 112 may also function as the omnidirectional radar retroreflector 114. In this embodiment, the balloon 112, which is radar reflective, hoists a light source 116 and transmitter 118 into the air above a person 22 floating at the surface 24 of a body of water 26.

Referring to FIGS. 6 and 7, preferably the balloon 112 includes two intersecting disc-shaped portions 130, 132 which have radar reflective surfaces 134 and which are disposed substantially perpendicular to one another. Connected between adjacent surfaces of disc-shaped portions 130, 132 are web sections 136, such as sections of foil, which also have radar reflective surfaces 138. In an open and inflated position, the disc-shaped portions 130, 132 and the webs 136 of the balloon 112 form a total of eight sets of three substantially mutually-perpendicular radar reflective surfaces so that the balloon 112 forms an omnidirectional radar retroreflector. Additionally, the balloon 112 can include a radar-transparent outer cover (not shown) which encases and/or protects the disc-shaped portions 130, 132 and web sections 136 during storage, activation and use.

The balloon 112 is preferably retained within housing 128 prior to the activation of the marine personal locator 110. As above, upon activation, a source of pressurized gas (not shown) inflates and expands the balloon 112. As the balloon 112 expands and exits the housing 128, it hoists the light source 116 and transmitter 118 on the tether 120 above the person 22 in the water thereby increasing the likelihood of location and rescue.

It should be understood, of course, that the specific form of the invention herein illustrated and described is intended to be representative only. In this respect, the specific form of the marine personal locator employing the automatically-opening omnidirectional radar retroreflector may take any of a variety of forms. Accordingly, reference should be made to the following appended claims in determining the full scope of the invention.

What is claimed is:

1. A marine personal locator comprising:

a portable, user-wearable housing;

a tether connected to said housing;

a source of pressurized gas in said housing;

a balloon attached to said tether;

an omnidirectional radar retroreflector attached to said tether and including two resiliently deformable radar reflective discs connected along their respective diameters and including a plurality of collapsible, radar reflective web sections spanning between said discs;

said resiliently deformable discs being secured together substantially perpendicularly such that, when unconstrained, the discs spontaneously open and align perpendicular to one another without any external supporting structure;

upon the opening thereof, said collapsible, radar reflective web sections spanning between said discs form, with the discs, mutually perpendicular radar reflective surfaces;

said discs of said retroreflector being collapsible in a spiral configuration for storage within said housing.

2. A marine personal locator as in claim 1 wherein said marine personal locator further comprises a housing with a chamber having a minimum width and wherein said two discs further comprise diameters greater than said minimum width of said chamber.

3. A marine personal locator as in claim 1 further comprising a light source and a transmitter wherein said balloon, upon activation, suspends said light source and said transmitter on said tether.

4. A marine personal locator as in claim 1 wherein said two resiliently deformable discs comprise discs of sheet metal and wherein said web sections comprise metal foil.

* * * * *